US006596916B1

(12) United States Patent
Fisher

(10) Patent No.: US 6,596,916 B1
(45) **Date of Patent: *Jul. 22, 2003**

(54) METHODS OF DESTRUCTION OF CYANIDE IN CYANIDE-CONTAINING WASTE

(75) Inventor: Gary Fisher, Boardman, OR (US)

(73) Assignee: Waste Management, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/603,525

(22) Filed: Jun. 23, 2000

Related U.S. Application Data

(63) Continuation-in-part of application No. 09/519,789, filed on Mar. 7, 2000.

(51) Int. Cl.[7] ..... A62D 3/00

(52) U.S. Cl. ..... 588/246; 588/205; 588/221; 423/111

(58) Field of Search ..... 588/205, 224, 588/226, 246, 221; 423/111

(56) References Cited

U.S. PATENT DOCUMENTS

| | | | | | |
|---|---|---|---|---|---|
| 4,059,514 | A | * | 11/1977 | Jahnsen | 210/721 |
| 4,113,831 | A | | 9/1978 | Orth, Jr. et al. | 423/119 |
| 4,113,832 | A | | 9/1978 | Bell et al. | 423/119 |
| 4,145,268 | A | * | 3/1979 | Oehr | 204/149 |
| 4,157,942 | A | * | 6/1979 | Tuznik et al. | 205/99 |
| 4,158,701 | A | | 6/1979 | Andersen et al. | 423/119 |
| 4,160,808 | A | | 7/1979 | Andersen et al. | 423/119 |
| 4,312,760 | A | | 1/1982 | Neville | 210/724 |
| 4,622,149 | A | | 11/1986 | Devuyst et al. | 210/717 |
| 4,655,829 | A | | 4/1987 | Cashman | 75/101 |
| 4,735,784 | A | | 4/1988 | Davis et al. | 423/111 |
| 4,851,129 | A | | 7/1989 | Griffiths et al. | 210/695 |
| 4,927,459 | A | | 5/1990 | Gardner et al. | 75/685 |
| 5,015,396 | A | | 5/1991 | D'Orazio et al. | 210/763 |
| 5,024,822 | A | | 6/1991 | Hittner et al. | 423/111 |
| 5,164,174 | A | * | 11/1992 | Banker et al. | 423/659 |
| 5,222,448 | A | | 6/1993 | Morgenthaler et al. | 110/346 |
| 5,266,203 | A | | 11/1993 | Mukhopadhyay et al. | 210/638 |
| 5,286,274 | A | | 2/1994 | Lindkvist et al. | 75/10.48 |
| 5,364,447 | A | | 11/1994 | Philipp et al. | 75/500 |
| 5,496,392 | A | | 3/1996 | Sims et al. | 75/414 |
| 5,709,730 | A | | 1/1998 | Cashman | 75/10.63 |
| 5,711,018 | A | | 1/1998 | Hittner et al. | 588/201 |
| 5,723,097 | A | | 3/1998 | Barnett et al. | 423/111 |
| 5,830,815 | A | | 11/1998 | Wagh et al. | 501/155 |
| 6,190,626 | B1 | | 2/2001 | Cashman | 423/111 |

FOREIGN PATENT DOCUMENTS

| | | |
|---|---|---|
| IN | 0171567 | 11/1992 |
| WO | 9830499 | 7/1998 |

OTHER PUBLICATIONS

Mohamed, Abel Yousef, "Oxidation of Hydroxyethyl Cellulose with Sodium Hypochlorite," *Transactions of Egypt Society of Chemical Engineers 16*(2): 74–88 (1990).

STN (Chem. Abstracts) Document No. 70:30297, Chem. Abstract of Indian Patent IN 95454, Published Oct. 22, 1966, "Oxidation of Polysaccharides".

Goldberg et al., The effect of multiple interferences of the determination of total cyanide in simulated electroplating waste by EPA method 335.4, Proceedings of the seventeenth annual EPA conference on analysis of pollutants in the environment, Norfolk, VA, pp. 395–427, (1994).

Land Disposal Restrictions; Treatment Standards for Spent Potliners From Primary Aluminum Reduction (KO88); Final Rule, Environmental Protection Agency, www.epa.gov/fedrgstr/EPA–Waste/1998/September/day–24/f25643.htm, (1998).

Total and Amenable Cyanide: Distillation, Methods 9010B and 9013,www.epaoswer/hazwaste/test/9010b.pdf, (1996).

"The analysis of cyanides", in 'The Chemistry and Treatment of Cyanide Wastes' by A. Smith and T. Mudder, pp. 21–45, Mining Journal Books Limited, (1991).

Guidelines Establishing Test Procedures for the Analysis of Pollutants; Available Cyanide in Water, Environmental Protection Agency, 40 CFR Part 136, Dec. (1999).

Mavis, J. "Aluminum Industry" in Pollution Prevention Handbook, T.E. Higgins Ed., CRC Lewis Publishers, pp. 377–388 (1995).

Potentiometric Determination of Cyanide in Aqueous samples and Distillates with Ion–Selective Electrode, Method 9213, "Test Methods for Evaluating Solid Waste, Physical/Chemical Methods" Environmental Protection Agency publication SW–846, Dec. (1996).

Total and Amenable Cyanide (Automated Colorimetric, with Off–Line Distillation) Method 9012A, in "Test Methods for Evaluating Solid Waste, Physical/Chemical Methods" Environmental Protection Agency publication SW–846, Dec. (1996).

* cited by examiner

*Primary Examiner*—Steven Bos
*Assistant Examiner*—Anthony Kuhar
(74) *Attorney, Agent, or Firm*—Stephanie L. Seidman; Dale L. Rieger; Heller Ehrman White & McAuliffe, LLP.

(57) ABSTRACT

Methods of treatment of cyanide-containing waste are provided. In particular, methods for treatment of spent potliner prior to landfill disposal are provided. These methods, which involve treatment of the waste with a mixture containing an aqueous oxidizing solution and an agent, such as magnesium chloride, that increases the oxidation potential of the solution, can be performed at ambient temperature and pressure.

8 Claims, No Drawings

METHODS OF DESTRUCTION OF CYANIDE IN CYANIDE-CONTAINING WASTE

RELATED APPLICATIONS

This application is a continuation-in-part of U.S. application Ser. No. 09/519,789 to Gary Fisher, filed Mar. 7, 2000, entitled "METHODS OF DESTRUCTION OF CYANIDE IN CYANIDE-CONTAINING WASTE." U.S. application Ser. No. 09/519,789 is incorporated by reference herein in its entirety.

FIELD OF INVENTION

Provided herein are methods for the destruction of cyanide in cyanide-containing waste. In particular, methods for the destruction of cyanide in Spent Potliner are provided.

BACKGROUND

The Hall-Heroult process for the production of metallic aluminum dates from the 19th century. Many refinements to the process have been made, but processes that use the basic Hall-Heroult process remain the most common processes for aluminum production throughout the world. In these processes, the bottom and internal walls of a cathode of an aluminum pot are formed with a liner of carbon blocks joined by conductive carbonaceous binder and wrapped with refractory firebricks and insulating bricks. The resulting combination is referred to as "potliner." The insulating bricks and firebricks are composed of material such as silica and alumina (aluminum oxide).

During the production of aluminum, the aluminum reduction pot is filled with a bath of alumina and molten salts. Over the three to seven year life span of an aluminum reduction pot, bath salts migrate into the potliner, thereby resulting in the deterioration and eventual failure of the aluminum cell as a cathode. During its lifespan, a cathodic potliner may absorb its own weight in bath salt materials. The failed potliner material is referred to herein as "spent potliner."

When an aluminum reduction cell is taken out of service, the spent potliner is cooled and fractured to facilitate handling and disposal. The fractured spent potliner is a nonhomogeneous material that contains carbon, silica and/or alumina from the insulating brick and firebricks, aluminum, significant quantities of sodium salts, aluminum salts and oxides, fluoride salts and traces of cyanides. On the average, a large aluminum smelter with a production capacity of 175,000 tons of aluminum per year will produce about 6,000–12,000 tons of spent potliner per year. The quantity of spent potliner generated annually in the United States exceeds approximately 230,000 tons per year.

The first cut of the spent potliner contains the carbon portion of the materials contained inside the two-electrode reduction cell. The second cut, which the U.S. Environmental Protection Agency (EPA) does not list as a hazardous waste, includes the other materials contained in the potliner. The spent first cut of the potliner (hereinafter referred to as "Spent Potliner") has long been listed as a hazardous waste by the EPA and state environmental authorities based on toxicity and the presence of cyanide complexes. Regulations require treatment of listed Spent Potliner to reduce cyanide concentrations and other constituent compounds before it can be disposed in a landfill.

Because of its cyanide content, its high concentrations of other constituent compounds, and the high volumes of Spent Potliner produced, Spent Potliner presents a potential environmental hazard and a major burden for aluminum producers, who remain ultimately liable for the proper disposition of Spent Potliner.

There are a variety of approaches for reducing the potential toxicities of Spent Potliner. One technique includes combustion or incineration of the Spent Potliner (see, e.g., U.S. Pat. Nos. 4,735,784; 4,927,459; 5,024,822; 5,164,174; 5,222,448 and 5,286,274). Most of these processes result in a product in the form of glassy slag material that still contains some hazardous components.

Other processes include chemical treatment (see, e.g., U.S. Pat. No. 4,113,831). In these processes, the initial Spent Potliner constituents are replaced with compounds that are less toxic, but which still include hazardous components at levels above those established by various environmental authorities.

Another treatment involves pyrohydrolysis of the Spent Potliner in conjunction with the introduction of water to create an off-gas containing fluoride materials present in the Spent Potliner (see, e.g., U.S. Pat. No. 4,113,832). Such pyrohydrolysis techniques may also be used with fluidized bed reactors (see, e.g., U.S. Pat. Nos. 4,158,701 and 4,160,808). These processes tend to produce large volumes of waste material that must be disposed in landfills and that may contain non-leachable hazardous waste.

Other methods for treating cyanide-containing wastes, such as Spent Potliner, can be divided into two groups: methods that destroy cyanide by breaking the ion to form simpler, non-hazardous compounds (such as carbon dioxide and nitrogen gas) by an oxidation or electrolytic decomposition; and methods that reduce the volume of cyanide waste by evaporation, reverse osmosis or ion exchange.

Oxidation has been used in the destruction of cyanide to form carbon dioxide and nitrogen. The process generally is effective in destroying free cyanide and some cyanide complexes. Oxidation of cyanide wastes is achieved through the addition of chlorine under alkaline pH conditions (alkaline chlorination), such as through the addition of sodium hypochlorite or through the addition of ozone (ozonation) or hydrogen peroxide (peroxidation) at elevated temperature and pressure. These processes involve handling large volumes of toxic and/or corrosive chemicals and generally are not effective on wastes that contain complexed cyanides, such as the cyanides present in Spent Potliner generated by many aluminum companies.

Electrolytic decomposition involves passing an electric current through the cyanide solution to break the cyanide ion. The process is effective in the destruction of free and complexed forms of cyanide. Electrolytic decomposition, however, is a very expensive process because of the large amounts of electrical energy consumed and is applicable only where the cyanide concentrations are at a relatively high level. High capital equipment costs are also associated with the process.

Hence, there is still a need to develop methods for treatment of Spent Potliner to produce waste authorized for disposal in a landfill. Accordingly, it is an object herein to provide methods for treatment of cyanide-containing wastes, particularly, Spent Potliner material from aluminum reduction cells, for disposal in a landfill.

It is another object herein to provide methods for the chemical destruction of cyanide (free or as a metal complex), such as that present in Spent Potliner, for disposal in a landfill. It is another object herein to provide methods for the destruction of cyanide (free or as a metal complex) that are safe and cost effective.

SUMMARY OF THE INVENTION

Provided herein are methods for treatment of cyanide-containing hazardous waste, particularly metal-containing waste, such as that generated by the aluminum industry. In particular, methods for treatment of Spent Potliner for destruction of cyanide are provided. The methods provided herein involve treating the waste, such as Spent Potliner, with an aqueous oxidizing solution that contains a sufficient amount of oxidizing agent to reduce the cyanide concentrations. The cyanide concentrations can be lowered to levels required by the EPA for landfill disposal. Hence the methods provided herein lower levels to about 590 parts per million (ppm) total cyanide or less and 30 ppm amenable cyanide or less, and preferably to 500 ppm total cyanide or less. These methods advantageously can be performed at ambient temperature and pressure. Typically the reaction is complete within an hour.

The time for completion will vary as a function of cyanide concentration, forms of cyanide present and reagent concentrations. The precise conditions and concentration reagents for particular types of waste and sources thereof may be readily determined empirically based upon the instant disclosure.

The aqueous oxidizing solution preferably contains a hypochlorite, a peroxide or a permanganate, and more preferably the aqueous oxidizing solution contains calcium hypochlorite or sodium hypochlorite, most preferably sodium hypochlorite. The effectiveness of the oxidizing solution is enhanced by adding an agent that increases the oxidation/reduction potential (ORP) of the oxidizing solution to enhance cyanide destruction.

The concentration or amount of oxidizing agent used depends upon the initial concentration of cyanide in the waste, and can be determined empirically or adjusted during the reaction. For example, the progress of a reaction can be assessed by monitoring the oxidation potential of a mixture of the waste, such as Spent Potliner, and aqueous oxidizing solution. The desired oxidation potential of an aqueous oxidizing waste mixture following the treatment of, for example Spent Potliner, is preferably greater than about 400 millivolts (mv). If there is remaining cyanide above the desired level, additional aqueous oxidizing solution is added.

Agents that enhance the ORP of the waste for destruction of cyanide in the waste, such as crushed Spent Potliner, include, but are not limited to, chlorine gas that is bubbled into the solution, hydrogen peroxide, ozone in solution, magnesium chloride, potassium chloride and also potassium permanganate. Magnesium chloride and potassium chloride are preferred; magnesium chloride is most preferred. If permanganate is used, the pH of the solution must be monitored to ensure that it remains alkaline.

A carbonate or other buffering agent can be optionally added for treatment of certain cyanide-containing waste. It has been found that for treatment of Spent Potliner, addition of a carbonate is not necessary.

Of the agents noted above that enhance the ORP, those that enhance the ORP sufficiently to permit destruction of complexed cyanides in the absence of an agent such as a carbonate are preferred. These agents include, but are not limited to, chlorine gas that is bubbled into the solution, hydrogen peroxide, ozone in solution, magnesium chloride and also potassium permanganate.

As used herein, an agent that enhances the ORP of the oxidizing solution is an agent that increases the oxidization strength of the oxidizing solution. Any such agent that achieves this result is contemplated herein. As noted, such agents include, but are not limited to, bubbled chlorine gas in the solution, hydrogen peroxide, ozone in the solution, magnesium chloride and potassium permanganate. Preferred are agents that enhance the oxidation strength sufficiently to destroy complexed cyanides, particularly in the absence of additional agents, such as a carbonate. Such agents include, but are not limited to magnesium chloride.

In an embodiment of the methods provided herein for the treatment of the waste, such as Spent Potliner, a metal chloride is also included in the aqueous oxidizing solution. In particular, the waste, such as the Spent Potliner, is contacted with a mixture containing the aqueous oxidizing solution and the metal chloride or other agent that increases the ORP of the aqueous oxidizing solution in amounts and for a time sufficient to reduce the cyanide levels, preferably to EPA required levels, particularly lower than 590 ppm total cyanide. As noted, the reaction can be performed at ambient temperature and pressure. In addition, the waste, such as the Spent Potliner is preferably crushed, to preferably fine powder containing pieces of a size from about 0.25 inch minus (i.e., less than ¼ inch) to about 1.25 inch minus, prior to treatment.

The metal chloride is selected from alkali metal chlorides and alkaline earth metal chlorides. The preferred metal chloride is magnesium chloride, and preferably the aqueous oxidizing solution contains magnesium or calcium ions.

DETAILED DESCRIPTION

A. Definitions

Unless defined otherwise, all technical and scientific terms used herein have the same meaning as is commonly understood by one of skill in the art to which this invention belongs. All patents, patent applications and publications referred to herein are incorporated by reference in their entirety.

As used herein, "potliner" refers to the carbonaceous material cell lining and insulating lining which form the bath-holding cavities of the aluminum reduction smelting cells.

As used herein, "Spent Potliner" refers to the aged and degraded carbonaceous material cell lining and insulating lining that is removed from the smelting cell because it has become intercalated with cyanides, fluorides, polynuclear aromatics (PNA's) or heavy metals (such as lead, beryllium, and cadmium), and is listed as a hazardous waste by the EPA. When capitalized and written as "Spent Potliner," it is the EPA listed material that is contemplated.

As used herein, "cyanide" refers to free cyanide ($CN^-$, HCN) and complexed cyanides. Cyanides are determined by standard methods. Cyanide may be present in several forms in waste and is classified according to the difficulty of the digestion step in the calorimetric determination method prescribed by the EPA:

1. Free cyanide $CN^-$, HCN;
2. Simple cyanide compounds, including the readily soluble NaCN, KCN, $Ca(CN)_2$, $Hg(CN)_2$, and relatively insoluble, including $Zn(CN)_2$, CuCN, $Ni(CN)_2$ and AgCN;
3. Weak metal-cyanides, including $Zn(CN)_4^{2-}$, $Cd(CN)_3^-$ and $Cd(CN)_4^{2-}$;
4. Moderately strong cyanides, including $Cu(CN)_2^-$, $Cu(CN)_3^-$, $Ni(CN)_4^{2-}$ and $Ag(CN)_2^-$; and
5. Strong metal-cyanides, such as $Fe(CN)_6^{3-}$, $Fe(CN)_6^{4-}$, $Co(CN)_6^{4-}$, $Au(CN)_2^-$ and $Hg(CN)_4^{2-}$.

Cyanides in group 5 do not appear to be digested in the methods for amenable cyanide determination prescribed by the EPA.

As used herein, "amenable cyanide" refer to the portion of the cyanides present in waste that can be chlorinated and destroyed by bleach.

As used herein, "metal chloride" refers to either alkali metal (Li, Na, K, Rb, Cs, Fr) or to certain alkaline earth metal (Be, Mg, Sr, Ba, Ra) chlorides.

As used herein, "an aqueous solution of metal chloride" refers to a solution comprising a metal chloride and water.

As used herein, "metal hypochlorite" refers to either alkali metal (Li, Na, K, Rb, Cs, Fr) or to alkaline earth metal (Be, Mg, Ca, Sr, Ba, Ra) hypochlorites. Alkali metal hypochlorites include sodium hypochlorite (NaOCl) and alkali earth metal hypochlorites include calcium hypochlorite ($Ca(OCl)_2$)

As used herein, "ambient temperature and pressure" refers to temperature and pressure of the environment where Spent Potliner is treated. Typically, such temperature ranges from about 0° C. to about 40° C. and ambient pressure is about 1 atm.

As used herein, "an oxidizing agent" refers to a substance that oxidizes something especially chemically as by accepting electrons.

As used herein, "an aqueous oxidizing solution" refers to any solution containing an oxidizing agent and water.

As used herein, "a reducing agent" refers to a substance that reduces a chemical compound usually by donating electrons.

As used herein, "oxidation potential" refers to the tendency of an element, metal or non-metal, or an ion, to be oxidized, or to give up electrons.

As used herein, "reduction potential" refers to the tendency of an element, metal or non-metal, or an ion, to be reduced, or to accept electrons.

As used herein, "oxidation-reduction potential" refers to a measure of the oxidizing or reducing strength of a solution. An oxidizing agent has a potential to acquire electrons and become reduced while a reducing agent has a potential to donate electrons and become oxidized.

As used herein, "an oxidation-reduction reaction" refers to when electrons are transferred from one species to another in a chemical reaction. Oxidation and reduction reactions occur together, the, electrons generated by a oxidation reaction must be acquired by an reduction reaction. The electron transfer between the two species continues until an equilibrium is reached.

As used herein, "measuring the oxidation potential" refers to any electrochemical method of determining the tendency of an element, metal or non-metal, or an ion, to be oxidized, or to give up electrons.

As used herein, "EPA landfill waste disposal standards" refers to the standards promulgated by the EPA, and can be readily accessed (see, e.g.,40 C.F.R. Parts 268 and 271, Land Disposal Restrictions; Treatment Standards for Spent Potliners From Primary Aluminum Reduction (K088); Final Rule. Maximum cyanide concentration permitted in waste from sources, such as Spent Potliner, for disposal in landfills is 590 ppm total cyanide and 30 ppm amenable cyanide. The methods herein reduce concentrations to these levels or below these levels.

Cyanide Wastes

Cyanide is used industrially in the form of sodium cyanide (NaCN) and hydrocyanic acid (HCN). These compounds are used as raw materials or as processing chemicals in various industrial operations, such as in mining, photographic processing, synthetic fiber manufacturing, steel processing, industrial gas scrubbing and electroplating. The major source of waste cyanide is produced by the electroplating industry, where cyanide is used in plating baths to hold metal ions such as zinc and cadmium in solution. The methods provided herein may be used to treat cyanide-containing waste from any source, including the electroplating industry.

Cyanide is present in Spent Potliners and in industrial waste streams in either of two forms: free cyanide ($CN^-$), and complexed cyanide (such as $FeCN^-$). Free cyanide in solution is quite amenable to destruction by oxidation methods. Destruction of complexed forms of cyanide (i.e., "cyanide complexes" or "complexed cyanide") in solution by means of oxidation is highly dependent on the complexing ion associated with the cyanide radical. The relative stability among cyanide complexes varies depending on the complexing ion that is bound to the cyanide radical.

The preferred embodiments herein are directed to the destruction of cyanide present in Spent Potliner, and practice of the methods herein is exemplified with Spent Potliner.

Spent Potliners as Hazardous Waste

Spent Potliners from primary aluminum reduction (40 CFR 261.32, Industry and EPA hazardous waste No. K088) is generated by the aluminum manufacturing industry. Aluminum production occurs in four distinct steps: (1) mining of bauxite ores; (2) refining of bauxite to produce alumina; (3) reduction of alumina to aluminum metal; and (4) casting of the molten aluminum. Bauxite is refined by dissolving alumina (alumina oxide) in a molten cryolite bath. Next, alumina is reduced to alumina metal. This reduction process requires high purity aluminum oxide, carbon, electric power, and an electrolytic cell. An electric current reduces the alumina to aluminum metal in electrolytic cells, called pots. These pots contain a steel shell lined with brick with an inner lining of carbon. During the pot's service, the liner is degraded and broken down. Upon failure of a liner in a pot, the cell is emptied, cooled, and the lining is removed. In 1980, the EPA originally listed Spent Potliners as a hazardous waste and assigned the hazardous waste number K088 (see, 45 FR 47832). Later in 1980, the EPA determined that a Congressional act excluded Spent Potliner from being listed as a hazardous waste (see, 45 FR 76619). In 1988, the EPA listed Spent Potliner as a hazardous waste, effective in 1989 (see, 53 FR 35412).

The EPA has promulgated treatment standards for Spent Potliners from primary aluminum reduction (EPA hazardous waste: K088) under its Land Disposal Restrictions (LDR) program. The purpose of the LDR program, authorized by the Resource Conversation and Recovery Act of 1976, as amended by the Hazardous and Solid Waste Amendments of 1984, is to minimize threats to human health and the environment due to the land disposal of hazardous wastes. As a result, Spent Potliners are prohibited from land disposal unless the wastes have been treated in compliance with the numerical standards contained in the LDR program rules. These treatment standards are necessary to minimize threats to human health and the environment from exposure to hazardous constituents which may potentially leach from landfills to groundwater.

Entities potentially affected by this action are generators of Spent Potliner from primary aluminum reduction, or entities that treat, store, transport, or dispose of these wastes.

Chemistry

The methods provided herein are useful for effectively and efficiently destroying or oxidizing cyanide (free cyanide and cyanide complexes) in cyanide-containing waste, such as Spent Potliner. The methods contact the waste with an oxidizing agent. In particular embodiments, the waste is treated with a mixture of an oxidizing agent and a metal chloride (or other agent that increases the oxidation potential of the mixture) in an aqueous solution. The combination of these two reagents acts to destroy or oxidize cyanide, and result in a mixture with acceptable levels of cyanide for landfill disposal. The reactions can be performed in air at ambient temperature and pressure, to destroy either free or complexed cyanide.

The chemistry described herein is useful for treatment of waste in settings apart from destroying cyanides in Spent Potliner. The preferred embodiments of the methods described herein are exemplified with reference to destroying cyanides present in Spent Potliner.

The combination of an oxidizing agent such as calcium hypochlorite ($Ca(OCl)_2$), potassium hypochlorite (KOCl) and sodium hypochlorite (NaOCl), and a metal chloride such as magnesium chloride ($MgCl_2$), in an aqueous solution, generates among other products, carbon dioxide ($CO_2$). For some wastes, if needed, a buffering agent, such as a carbonate, is optionally added to avoid production of undesirable volatiles and gases. For treatment of Spent Potliner, such agent is not needed.

For purposes herein, preferred are agents that enhance the oxidation strength sufficiently to destroy complexed cyanides, particularly in the absence of additional agents, such as a carbonate. Such agents include, but are not limited to: $MgCl_2$. Thus in preferred embodiments herein, the oxidizing solution will contain two components: a metal halide, such as $MgCl_2$, and an oxidizing agent. These preferred mixtures are sufficient to destroy complexed cyanides in the waste, particularly at ambient temperature and pressure.

The combination of these reagents causes the cyanides first to partition into the aqueous phase and then to oxidize. When calcium hypochlorite or sodium hypochlorite is used alone, cyanides, especially when the cyanide is bound with iron or copper, are not effectively destroyed because the reaction rate is slow or non-existent. Addition of magnesium chloride enhances this reaction substantially. Without being bound by any theory, it appears that magnesium chloride appears to accelerate the reaction that destroys the cyanide. Thus, the combination of magnesium chloride and calcium or sodium hypochlorite in an aqueous solution provides an effective means for the destruction of cyanides in wastes, such as Spent Potliner.

The aqueous oxidizing solution contains an oxidizing agent that is present in sufficient amounts to oxidize or destroy cyanide. Oxidizing agents that are useful to destroy cyanide include but are not limited to: metal hypochlorites including alkali metal hypochlorites such as sodium hypochlorite (NaOCl) and potassium hypochlorite (KOCl), and alkaline earth metal hypochlorites such as calcium hypochlorite ($Ca(OCl)_2$) and magnesium hypochlorite ($Mg(OCl)_2$); halogens such as fluorine, chlorine, bromine and iodine; permanganates such as potassium permanganate ($KMnO_4$); peroxides such as hydrogen peroxide; and peroxyacids such as peracetic acid.

Metal chlorides include, but are not limited to: alkali metal (Li, Na, K, Rb, Cs, Fr) chlorides, such as sodium chloride (NaCl) or certain alkaline earth metal (Be, Mg, Sr, Ba, Ra) chlorides. Magnesium chloride ($MgCl_2$) and potassium chloride (KCl) are presently preferred; magnesium chloride ($MgCl_2$) is most preferred.

An advantage of the present methods is the use of these inexpensive, safe and readily available reagents for the destruction of cyanide in Spent Potliners.

Another advantage of the present methods, includes the ability to monitor the levels of cyanide destruction in the treated Spent Potliner waste solution. Monitoring is accomplished by measuring the oxidation potential of the waste solution, using standard electrochemical methods including, but not limited to, potentiometric methods and calorimetric methods. Monitoring and adding additional oxidizing agent and/or metal chloride allow for the reduction of cyanide levels present in cyanide-containing waste, such as Spent Potliner, with minimal volumes of treated Spent Potliner waste.

For convenience and efficiency of the methods, when applied to Spent Potliner, the Spent Potliner is optionally crushed, such as in a crusher or a pulverizer, to give particles, preferably of a size from about 0.25 inch minus to about 1.25 inch minus prior to treatment.

Without being bound by any theory, the following reactions are believed to be involved in the methods, referred to as alkaline chlorination, provided herein.

Decomposition/oxidation of the Cyanide Ion

Oxidation and decomposition of free cyanide occurs in two stages. The cyanide is first oxidized to cyanates ($CNO^-$), and then is further oxidized to carbon dioxide, nitrogen gas and chlorides. Oxidation and decomposition of complexed cyanide occurs only with some species, such as the species 2–4 described above. These oxidation reactions are slower than those involving free cyanides. Metal hydroxides in addition to the bicarbonates and nitrogen gas are produced.

Other combined forms, particularly the strong metal-cyanides, such as $Fe(CN)_6^{3-}$, $Fe(CN)_6^{4-}$, $Co(CN)_6^{4-}$, $Au(CN)_2^-$ and $Hg(CN)_4^{2-}$, are not affected by chlorine or hypochlorite at room temperature since these forms are already in an oxidized state. Some or all of these forms may not be measured in the EPA methods for amenable cyanide determination. A description of the general oxidation reaction follows.

First Reaction Stage

In the first stage, cyanide is oxidized to cyanogen chloride in the presence of hypochlorite ion:

$$OCl^- + NaCN + H_2O \rightarrow CNCl + Na^+ + 2OH^-$$

These reactions occur instantaneously and are independent of pH. By controlling the pH to above 8, preferably 10 to 11, CNCl desirously is converted to a less volatile more stable compound:

$$CNCl + 2OH^- \rightarrow CNO^- + Cl^- + H_2O$$

Hence the overall reaction governing transformation of free cyanide to cyanates is:

$$OCl^- + CN^- \rightarrow CNO^- + Cl^-$$

Second Reaction Stage

In the second reaction stage, cyanates are further oxidized to ammonium and sodium carbonates in the presence of excess hypo-chlorite, which catalyzes the reactions:

$$4CNO^- + 3OCl^- + 8H_2O \rightarrow 3OCl^- + 2(NH_4)_2CO_3 + 2CO_3^-$$

The resulting ammonium carbonate is rapidly oxidized to form nitrogen gas and the carbonates are converted to bicarbonates:

$$2(NH_4)_2CO_3 + 6OCl^- + 2CO_3^- \rightarrow 4HCO_3^- + 2N_2 + 6Cl^- + 6H_2O$$

Small amounts of nitrous oxide and volatile nitrogen trichloride also can be formed in these reactions.

The overall reaction is as follows:

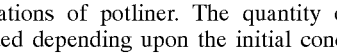

$$2CNO^{-}+3OCl^{-}+H_2O \rightarrow 2HCO_3^{-}+N_2+3Cl^{-}$$

Methods of Treatment of Spent Potliner

In a preferred embodiment, crushed Spent Potliner (about 0.25 inch minus) is treated with a mixture of sodium hypochlorite and magnesium chloride. This same mixture of reagents is used to treat the mixture of all of the other generations of potliner. The quantity of the reagents is adjusted depending upon the initial concentrations of cyanide in the Spent Potliner.

In a further embodiment, the metal chloride is about 35% aqueous magnesium chloride, and the ratio of the about 35% aqueous magnesium chloride to Spent Potliner is from about 5 to about 120 gallons per ton.

In a further embodiment, the ratio of the about 35% aqueous magnesium chloride to Spent Potliner is from about 10 to about 100 gallons per ton.

In a further embodiment, the aqueous oxidizing solution is about 13% aqueous sodium hypochlorite, and the ratio of the about 13% aqueous sodium hypochlorite to Spent Potliner is from about 20 to about 240 gallons per ton.

In a further embodiment, the ratio of the about 13% aqueous sodium hypochlorite to Spent Potliner is from about 30 to about 200 gallons per ton.

In another embodiment, cyanide-containing waste, such as Spent Potliner, is reacted with a metal chloride, such as magnesium chloride and a hypochlorite, whereby the cyanide is destroyed resulting in EPA-acceptable levels.

The methods provided herein are preferably performed at ambient temperature and pressure and can be performed in an open environment or in a sealed reactor, at ambient or elevated temperature and/or pressure.

The following example is included for illustrative purposes only and is not intended to limit the scope of the invention.

EXAMPLE

Spent Potliner with cyanide concentrations ranging from 600 to 1000 ppm total cyanide was treated in a field study. Using a formula of 1000 gallons of sodium hypochlorite, 800 pounds (lbs.) of water and 500 lbs. of magnesium chloride per 40000 lbs. of crushed Spent Potliner, the field study was performed on eleven loads. Using this mixture ratio, the treatment results, set forth in the following table, met EPA's LDR treatment standards.

| Test # | Total CN (ppm) | Amenable CN (ppm) |
|---|---|---|
| 1 | 338 | <25 |
| 2 | <25 | — |
| 3 | <25 | — |
| 4 | 406 | <25 |
| 5 | 299 | <25 |
| 6 | 97 | <25 |
| 7 | 58 | <25 |
| 8 | 251 | <25 |
| 9 | 396 | <25 |
| 10 | 157 | <25 |
| 11 | 39 | <25 |

Spent Potliner with greater cyanide concentrations also has been effectively treated using the methods provided herein.

Since modifications will be apparent to those of skill in this art, it is intended that this invention be limited only by the scope of the appended claims.

What is claimed is:

1. A method of treatment of solid hazardous waste containing cyanide to destroy cyanide, comprising:

treating the waste with an aqueous oxidizing solution and an agent that enhances the oxidation strength of the oxidizing solution sufficiently to destroy complexed cyanides, wherein the method is performed at ambient temperature and pressure.

2. The method of claim 1, wherein the agent is a magnesium chloride.

3. The method of claim 1, wherein the oxidizing solution comprises a hypochlorite, a peroxide or a permanganate.

4. The method of claim 1, wherein the concentration of cyanides after treatment is less than about 590 ppm total cyanide.

5. The method of claim 1, wherein the oxidizing solution comprises a hypochlorite.

6. The method of claim 1, wherein the oxidizing solution and the agent consist essentially of a magnesium chloride and a hypochlorite.

7. The method of claim 1, wherein the waste is Spent Potliner.

8. The method of claim 1, wherein the aqueous oxidizing solution is aqueous sodium hypochlorite and the agent is magnesium chloride.

* * * * *

UNITED STATES PATENT AND TRADEMARK OFFICE

CERTIFICATE OF CORRECTION

PATENT NO. : 6,596,916 B1
DATED : July 22, 2003
INVENTOR(S) : Gary Fisher

It is certified that error appears in the above-identified patent and that said Letters Patent is hereby corrected as shown below:

Title page,
Item [56], References Cited, FOREIGN PATENT DOCUMENTS, please add the following reference:
-- GB 195268 12/13/67 --
OTHER PUBLICATIONS, please add the following references:
-- Diel *et al.* "Complexed Metals In Hazardous Waste: Limitations of Conventional Chemical Oxidation," Proceedings of Superfund XV, Washington, D.C. (1994). Paper 6F-5.
Gerritsen *et al.* (1990) *Inorg. Chem. 29*:2757-2762.
Hebeish *et al.* (1973) *Amer. Dyest. Rep. 62(2)*:28, 30-2, 37.
Yousef, M. (1991) *Polym.-Plast. Technol. Eng. 30(4)*:413-423. --

Signed and Sealed this

Twenty-first Day of October, 2003

JAMES E. ROGAN
*Director of the United States Patent and Trademark Office*